US009896891B2

(12) United States Patent
Mullins et al.

(10) Patent No.: US 9,896,891 B2
(45) **Date of Patent: *Feb. 20, 2018**

(54) TOP DRIVE OPERATED CASING RUNNING TOOL

(71) Applicant: DrawWorks LP, Boling, TX (US)

(72) Inventors: Albert Augustus Mullins, Boling, TX (US); Matthew J. Hickl, El Maton, TX (US)

(73) Assignee: DRAWWORKS LP, Boling, TX (US)

( * ) Notice: Subject to any disclaimer, the term of this patent is extended or adjusted under 35 U.S.C. 154(b) by 359 days.

This patent is subject to a terminal disclaimer.

(21) Appl. No.: 14/306,904

(22) Filed: Jun. 17, 2014

(65) Prior Publication Data

US 2015/0107851 A1 Apr. 23, 2015

Related U.S. Application Data

(63) Continuation-in-part of application No. 14/056,362, filed on Oct. 17, 2013, now Pat. No. 9,416,601.

(51) Int. Cl.

| | |
|---|---|
| ***E21B 19/07*** | (2006.01) |
| ***E21B 19/00*** | (2006.01) |
| ***E21B 19/06*** | (2006.01) |

(52) U.S. Cl.

CPC ..... *E21B 19/07* (2013.01); *E21B 19/00* (2013.01); *E21B 19/06* (2013.01)

(58) Field of Classification Search

CPC ..... E21B 19/00; E21B 19/07; E21B 19/06; Y10T 74/18728; Y10T 74/18056; F16H 25/20

See application file for complete search history.

(56) References Cited

U.S. PATENT DOCUMENTS

| | | | |
|---|---|---|---|
| 5,971,079 | A | 10/1999 | Mullins |
| 6,173,777 | B1 | 1/2001 | Mullins |
| 6,311,792 | B1 | 11/2001 | Scott et al. |
| 6,578,632 | B2 | 6/2003 | Mullins |
| 7,028,769 | B2 | 4/2006 | Mullins |
| 7,665,515 | B2 | 2/2010 | Mullins et al. |
| 7,896,111 | B2 | 3/2011 | Slack |
| 7,909,120 | B2 | 3/2011 | Slack |
| 8,424,939 | B2 | 4/2013 | Slack et al. |
| 2004/0216924 | A1 | 11/2004 | Pietras et al. |
| 2006/0118293 | A1 | 6/2006 | Juhasz et al. |

(Continued)

*Primary Examiner* — Yong-Suk (Philip) Ro

(74) *Attorney, Agent, or Firm* — Steve Rosenblatt

(57) ABSTRACT

Spring loaded dogs are attached to the housing to engage the casing internally or externally to facilitate extension or retraction of the slips that selectively grab the topmost of a string of casing. When the tool is suspended from the top drive, its components are rotationally locked to facilitate insertion into the casing stand on top of a string being run in the hole. Some set down weight allows top drive rotation to move a multi-ramped mandrel axially because that mandrel is rotationally locked to the housing that is held fast by the spring loaded dogs bearing on the casing. Once the slips are extended with a specified torque applied from the top drive, further setting down weight locks the components and the housing so that applied rotation with setting down weight will turn the casing string but will not torque up the slips beyond their set position.

20 Claims, 11 Drawing Sheets

(56) References Cited

U.S. PATENT DOCUMENTS

| | | | | |
|---|---|---|---|---|
| 2008/0210063 | A1* | 9/2008 | Slack | E21B 19/06 81/420 |
| 2009/0114398 | A1 | 5/2009 | Buytaert et al. | |
| 2009/0274545 | A1* | 11/2009 | Liess | E21B 19/16 414/800 |
| 2009/0321086 | A1* | 12/2009 | Zimmermann | E21B 19/07 166/379 |
| 2011/0174483 | A1 | 7/2011 | Odell, II et al. | |
| 2011/0259577 | A1* | 10/2011 | Hughes | E21B 19/07 166/77.53 |
| 2012/0273232 | A1 | 11/2012 | O'Blenes | |

* cited by examiner

TOP DRIVE OPERATED CASING RUNNING TOOL

CROSS REFERENCE TO RELATED APPLICATION

This application is a continuation-in-part of U.S. patent application Ser. No. 14/056,362, for "Top Drive Operated Casing Running Tool", filed on Oct. 17, 2013, and claims the benefit of priority from the aforementioned application.

FIELD OF THE INVENTION

The field of the invention is tools that assemble and deliver tubular strings into a borehole and more particularly top drive driven tools that allow circulation, makeup and movement of the string as it is assembled into the borehole.

BACKGROUND OF THE INVENTION

In the past manipulation, threading and circulation of casing or tubulars was done with a variety of tools such as fill up and circulation tools that featured a seal to the inside or the outside of the tubular to be able to pump fluid as the tubular string was lowered into the borehole or to initially fill that last segment that was added to the string before running in. Typically the handling of a joint to be added to a string was done with elevators and the threading was accomplished with tongs. Such tools are illustrated in U.S. Pat. Nos. 6,578,632; 5,971,079; 7,028,769; 7,065,515 and 6,173,777.

More recently systems have been developed that employ the top drive for rotation and axial movement of a tubular joint to be made up to an existing string and advanced into the borehole. These are rather complex devices that rely on cam pairs to convert rotation to axial movement of slips that cams the slips radially outwardly or inwardly to grip the inside or the outside of a tubular. They feature opposed cam pairs to allow slip actuation with bi-directional rotation and a lock position in between to allow for release. These designs are highly complex and expensive to produce and present complications that could require significant downtime for maintenance. The design is illustrated in in U.S. Pat. Nos. 8,424,939 and 7,909,120.

In a first embodiment of the present invention enables selective grip and release of a tubular joint to thread a connection and to rotate a string while facilitating release to get the next joint in the string connected. The device may include a lower end seal preferably in the form of a cup seal and slips in a housing that respond to axial movement of an actuating member. The actuating member is connected to a clutched drive that is engaged for power delivery and disengaged with set down weight from the top drive. Drive rotation turns a thread that is engaged to the actuating member to move the actuating member axially in one of two opposed direction for radial extension or retraction of the slip segments. With the slips engaged the string can be rotated while lowered or lifted. With the string supported from the rig floor the top drive can radially allow the slips to retract with rotation. Those skilled in the art will have a better understanding of the present invention from the description of the preferred embodiment and the associated drawings while recognizing that the full scope of the invention is to be found in the appended claims.

In an alternative embodiment the components are rotationally locked to the housing of the tool as it is inserted into the casing as well as when weight is set down after the slips are extended to grab the casing. In between is a position that allows one or more parts to be rotated that engage with another part that is limited to axial movement so that a multi-ramped mandrel extends the slips to grip. When the slips are set with the needed torque the relatively rotating components are rotationally locked to the housing such that top drive rotation of the housing will turn the string rather than further trying to extend the slips, this avoiding potential damage to the casing from slip overextension.

SUMMARY OF THE INVENTION

A casing running tool is connected to a top drive with a clutch that operates with set down weight against a spring resistive force. Setting down weight with rotation in a first direction raises an actuation member that pushes the slips out radially. The weight of the string then keeps the slips in position so that the string can be picked up and the rig floor slips removed followed by lowering the string while circulating and rotating. With slips set inside the joint and the string hanging free rotating the top drive rotates the string as the string is lowered. With slips again supporting the string on the rig floor the top drive can be rotated in an opposed direction with weight set down to back off the slips and to remove it from the top joint.

In an alternative embodiment, spring loaded dogs can be attached to the housing to engage the casing internally or externally to facilitate extension or retraction of the slips that selectively grab the topmost of a string of casing. When the tool is suspended from the top drive, its components are rotationally locked to facilitate insertion into the casing stand on top of a string being run in the hole. Some set down weight allows top drive rotation to move a multi-ramped mandrel axially because that mandrel is rotationally locked to the housing that is held fast by the spring loaded dogs bearing on the casing. Once the slips are extended with a specified torque applied from the top drive, further setting down weight locks the components and the housing so that applied rotation with setting down weight will turn the casing string but will not torque up the slips beyond their set position which could cause stress cracks to the casing. A return spring returns the components to a rotationally locked position with respect to the housing so the process can be repeated after the slips get retracted with rotation in an intermediate position between hanging and weight fully set down. Components can be rotationally locked when driving in the string into the borehole with backpressure from circulating fluid employed to hold the components in a rotationally locked relation so that the string can be manipulated as it is inserted without slip radial movement in opposed directions.

DETAILED DESCRIPTION OF THE PREFERRED EMBODIMENT

Figure 1:
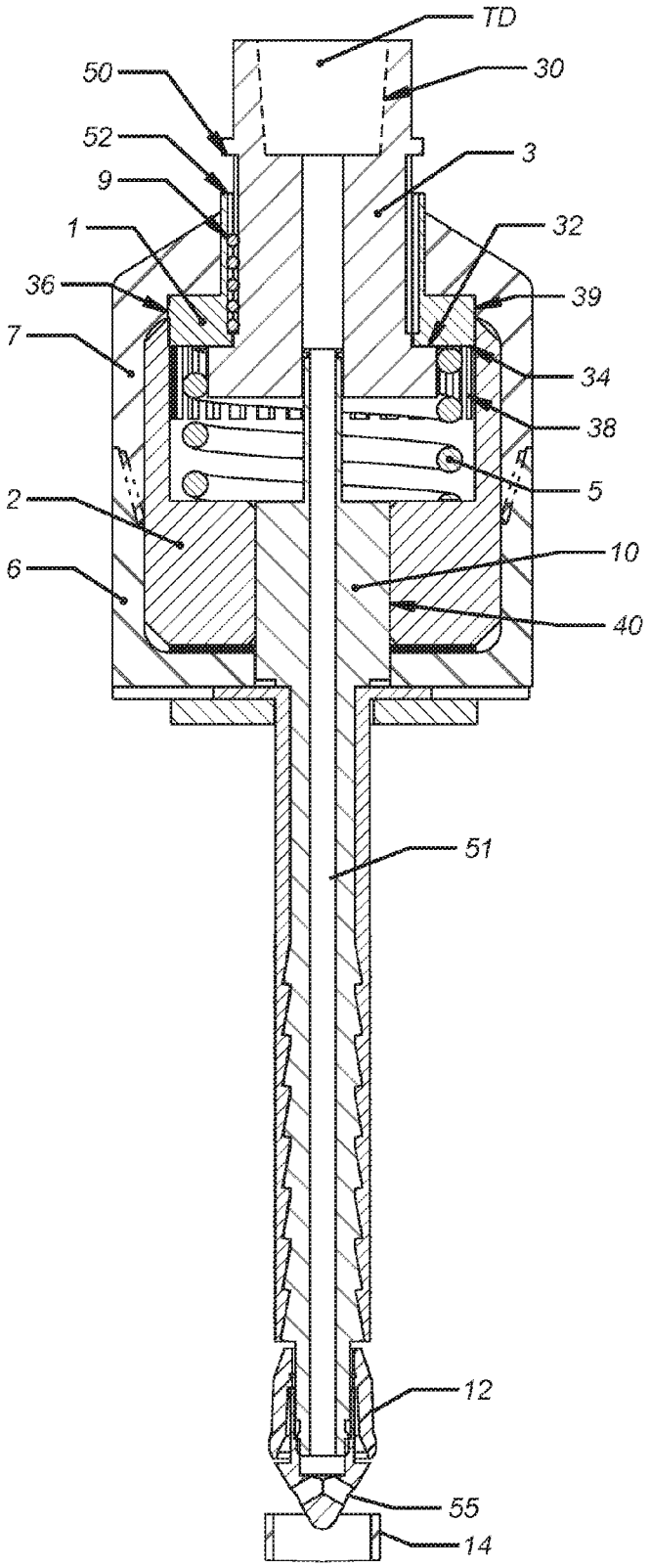
FIG. 1 shows the device in the run in position.
Figure 5:
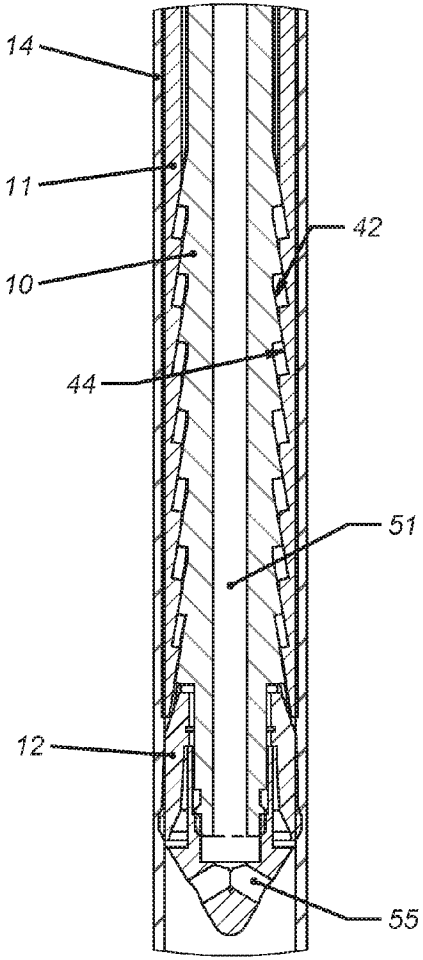
FIG. 5 shows the slips extended on the multiple ramps of the actuating member.
Figure 4:
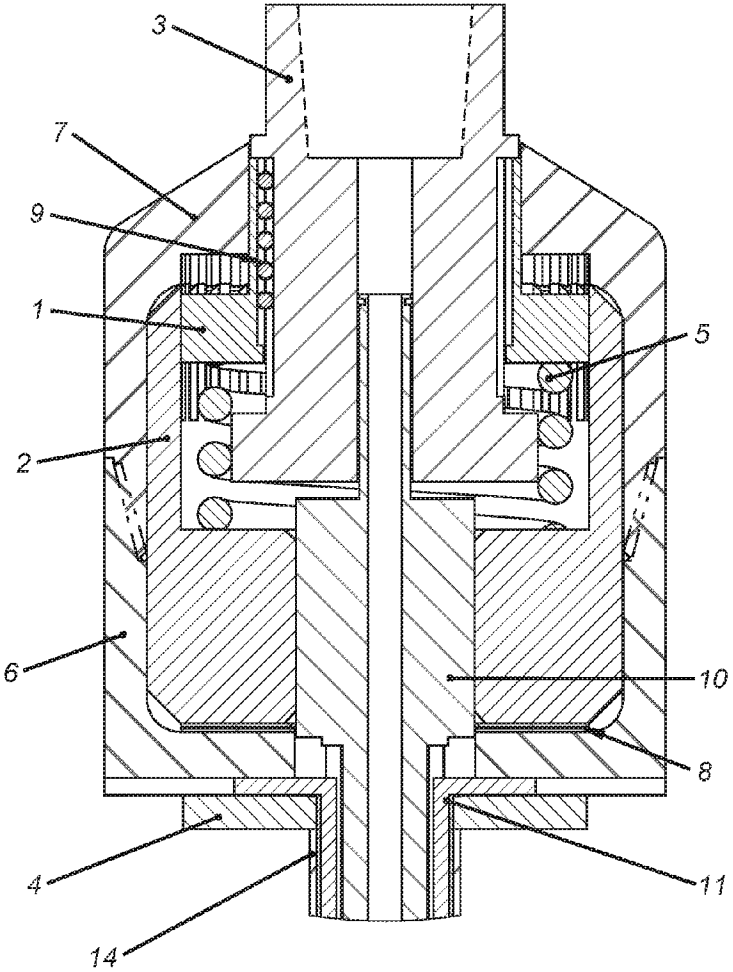
FIG. 4 shows the actuating member having moved up as a result of rotation that sets the slips.
Figure 6:
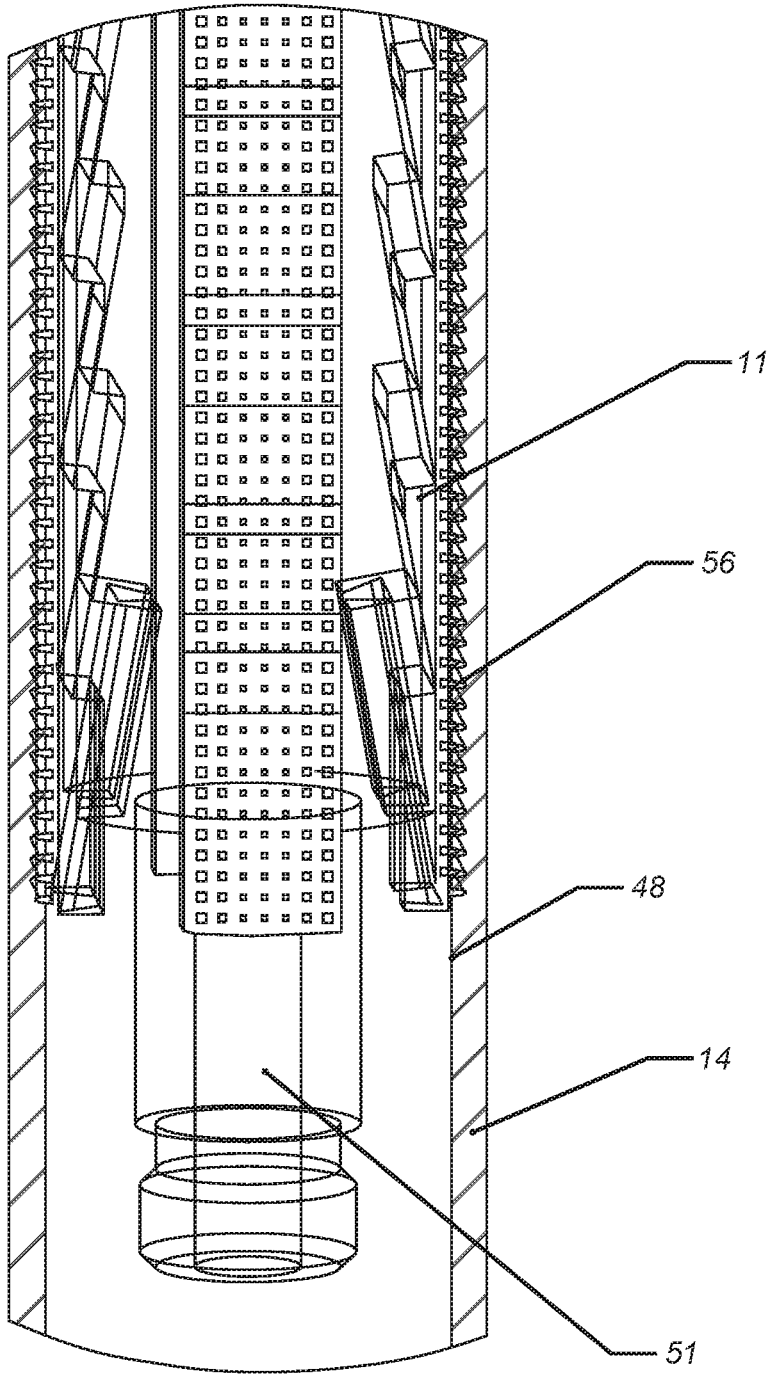
FIG. 6 is a close up showing three of four slips in the set position.
Figure 7:
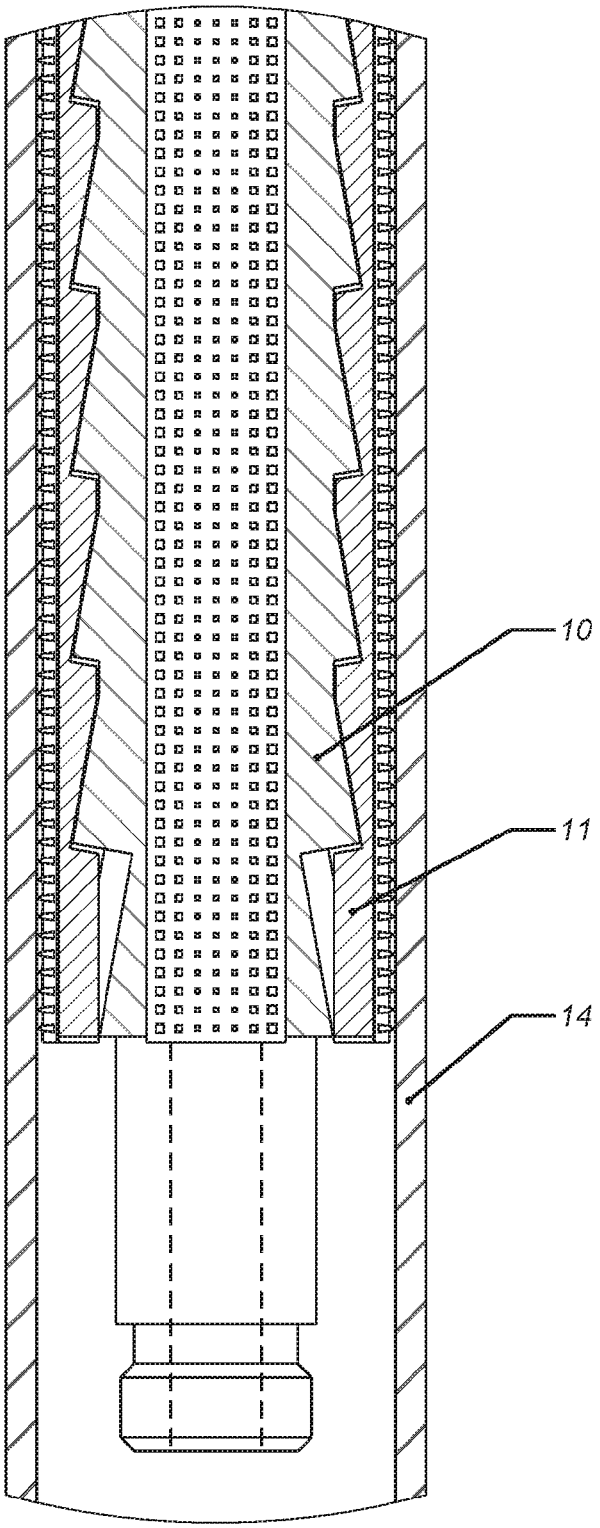
FIG. 7 is the view of FIG. 6 with the slips in the retracted position.
Figure 8:
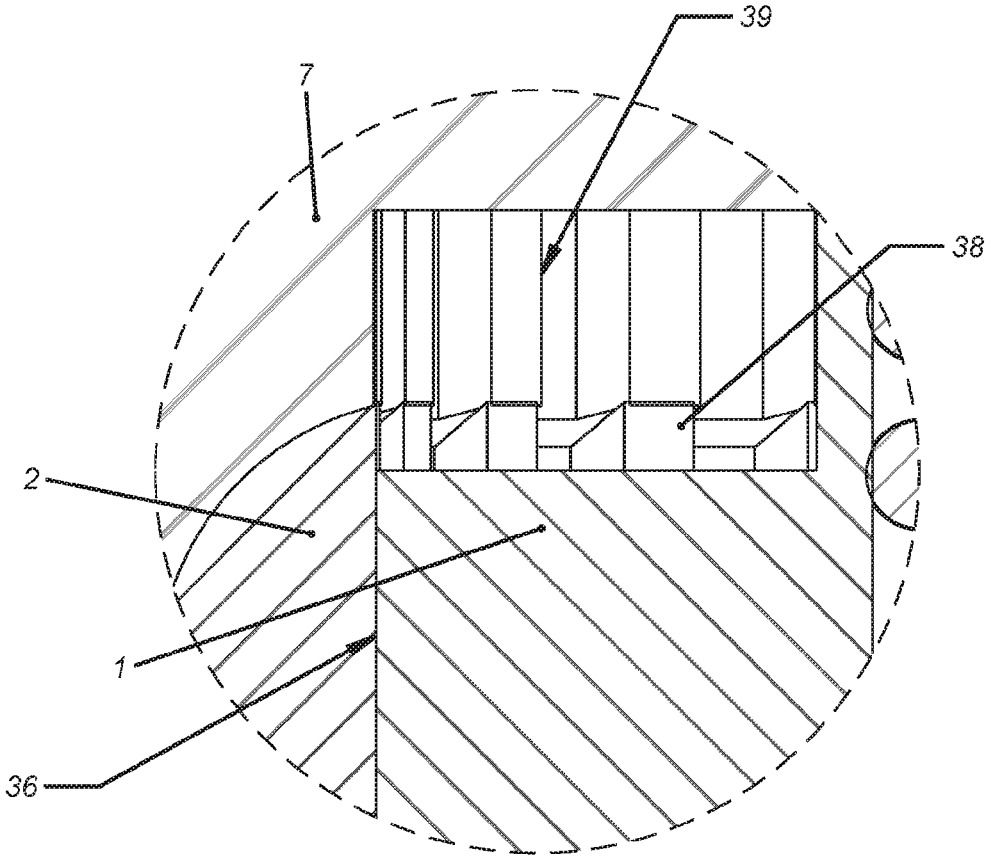
FIG. 8 is a detailed view of the spline inside the housing wall which acts as a rotational lock when there is no set down weight from the top drive.

Referring to FIG. 1 a top drive TD is schematically illustrated as supporting a top sub 3 at threads 30. The top sub 3 is rotationally locked to driving nut 1 that is captured above shoulder 32 leaving an exposed annular surface 34 on which spring 5 exerts and upward force. Driving nut 1 is rotationally locked to top sub 3 with locking balls 9 although other ways to rotationally lock can be used. Drive nut 1 has an exterior gear pattern or splines 36 that in the FIG. 1 position are engaged with an internal gear or splines 38 on driven nut 2 and with splines 39 on an interior wall of the housing 7 when subjected to the force of spring 5. Splines 39 are best seen in FIG. 8 when the driving gear 1 is pushed down to expose splines 39. Driven nut 2 is mounted to rotate in housing components 6 and 7. Driven nut 2 is connected to actuator 10 at thread 40 such that rotation of the driven nut 2 by driving nut 1 through meshed splines 36 and 38 result in axial translation of actuator 10 into or out of the coils of spring 5. As better seen in FIG. 5 ramps 42 on actuator 10 engage a parallel pattern of inclined ramps 44 on slip segments 11 that are mounted for radial extension into casing 14 for contact with the interior of a casing joint 48 that is shown in FIG. 6. A flow passage 51 leads to outlets 55 for circulating fluid as the casing string is lowered into a borehole. A cup seal 12 has a downward orientation to hold pressure in the casing string 14 with returns coming back to the surface outside the casing string 14.

Figure 2:
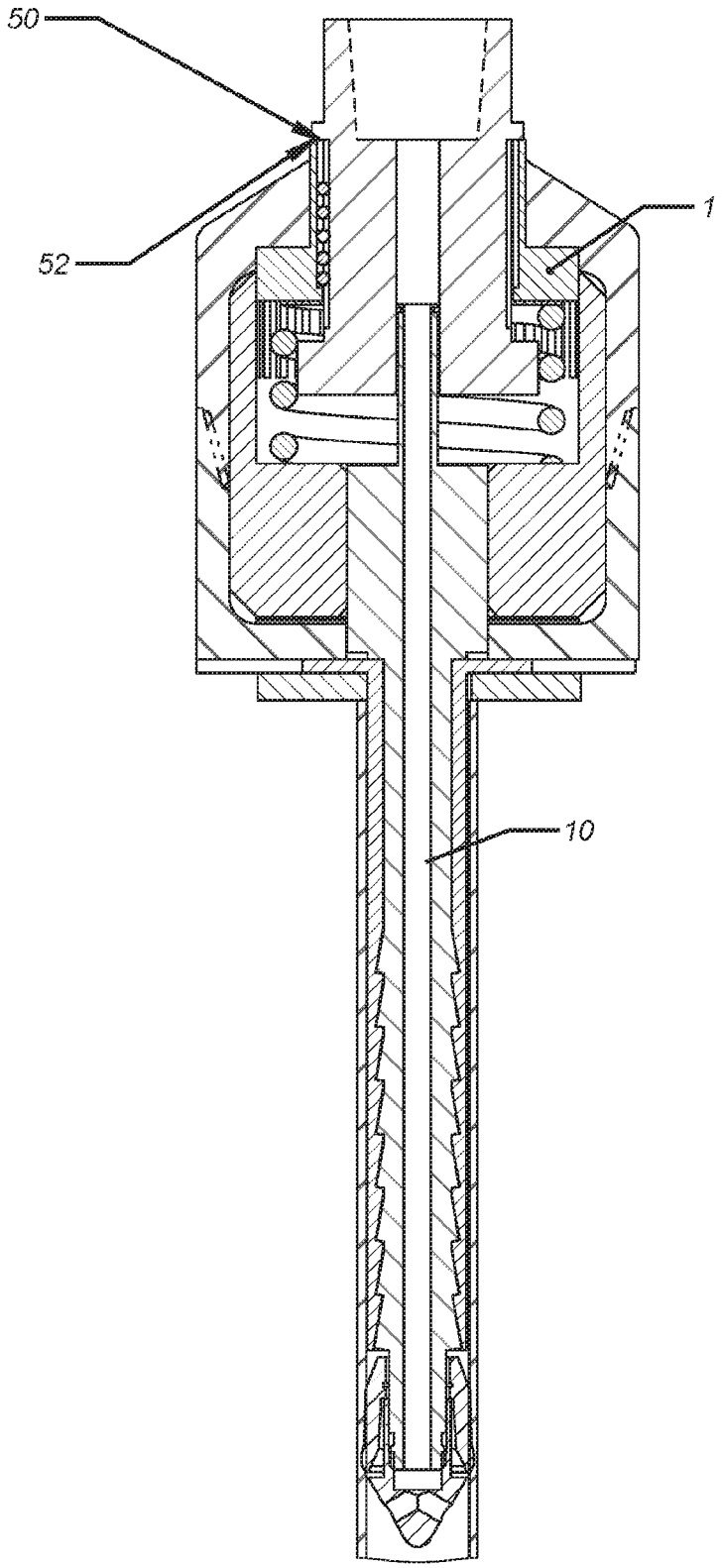
FIG. 2 is the view of FIG. 1 with weight set down before the spring is compressed.
Figure 3:
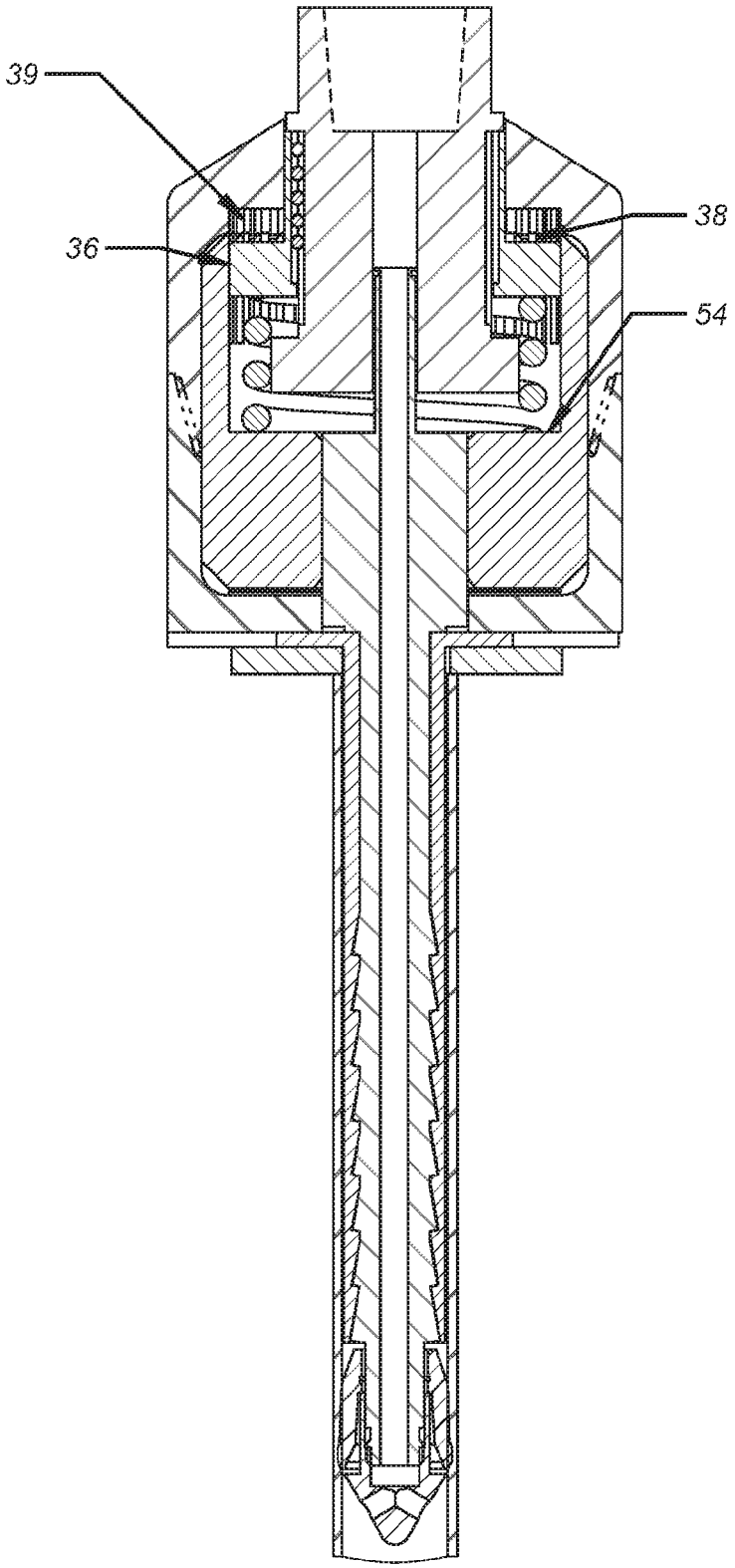
FIG. 3 is the view of FIG. 2 with the spring compressed just before rotation that will extend the slips.

To make the actuator 10 move axially, weight is set down with the top drive TD pushing the ring 50 against the top 52 of the driving nut 1, as shown in FIG. 2. Further setting down weight compresses spring 5 and moves the splines 36 out of splines 39 and only into splines 38 to create meshing engagement as shown in FIG. 3. Note that in this position the actuator 10 is about even with the spring support surface 54. At this point rotation of the top drive TD in one direction raises actuator 10 which pulls ramps 42 axially which results in radial movement of the slip segments 11 out until the wickers or grip profile 56 engages the tubular 14 on surface 48. With the slips segments 11 wedged into the tubular 14, the top drive TD is raised up so that the support slips in the rig floor that support the balance of the string below the tubular just threaded to the string, can be removed so that the top drive TD with slip segments 46 engaged to the tubular 48 now supports the string but splines have reengaged due to the return force of spring 5 and the fact that weight is no longer being set down as the entire string is hanging on the slip segments. At this point the splines on the driving nut 1 are engaged to splines 39 on the upper housing 7 so that top drive TD rotation simply turns the housing 6, 7 and with it the slip 11 that is secured to the housing 6, 7. The top drive TD can be turned in either direction with the string weight hanging without risk of release of the slips. The driller can watch the weight indicator to determine that the hanging condition of the string is maintained before operation of the top drive TD in rotation.

It should be noted that spring 5 is optional and the same result can be obtained by moving a precise distance in either or both opposed directions with the top drive to get the desired engagement that allows slip extension or tubular rotation with the weight of the string hanging off the top drive as well as the release of the slips from the string when needed.

In order to release from the string 14 after filling and circulating through the string 14 as it is advanced into the borehole, slips on the rig floor (not shown) are set to support the string 14 from the rig floor and allow weight to be set down by lowering the top drive TD so that the FIG. 3 position is resumed. At this point the top drive TD is made to rotate driving nut 1 and the driven nut 2 in the opposite direction than the direction that set the slip segments 46 to make the actuator 10 move back axially in a downhole direction to allow the slip segments to radially retract. When the actuator 10 moves down it will pull the slip segments 46 inward for a grip release.

Those skilled in the art will appreciate that spring 5 can take different forms such as a sealed volume with compressible gas inside or a stack of Bellville washers for example. The top sub 3 can be a guide for the axial movement of the actuator 10 while conducting flow through the cup seal 12. The rotational lock with balls 9 can be splines or other structures. The design is simple and can be built economically for reliable operation. Setting down weight allows extension or retraction of the slips when accompanied by rotation from the top drive. Without setting down weight and rotating the top drive with the slips extended the tubular supported by the slips turns in tandem with the housing 6,7 and the slips 11 that is non-rotatably attached to it.

Figure 9:
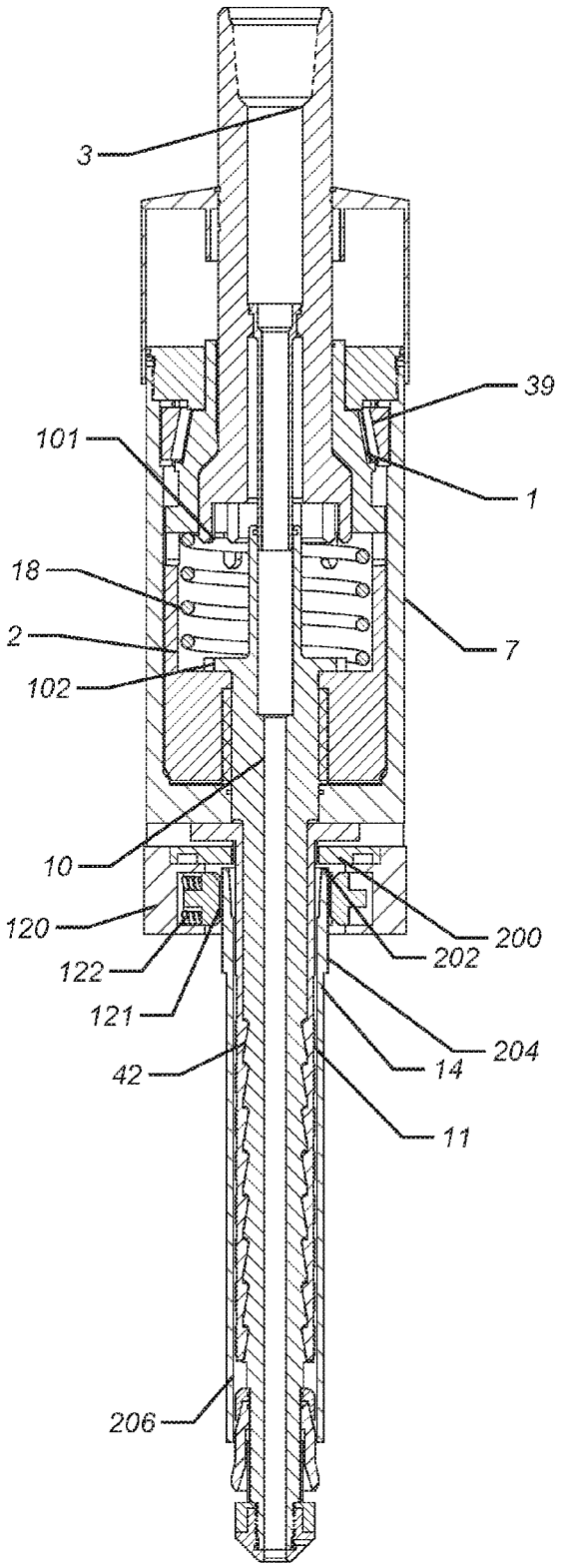
FIG. 9 is a section view of an alternative embodiment shown in the suspended position and inserted into the casing.
Figure 10:
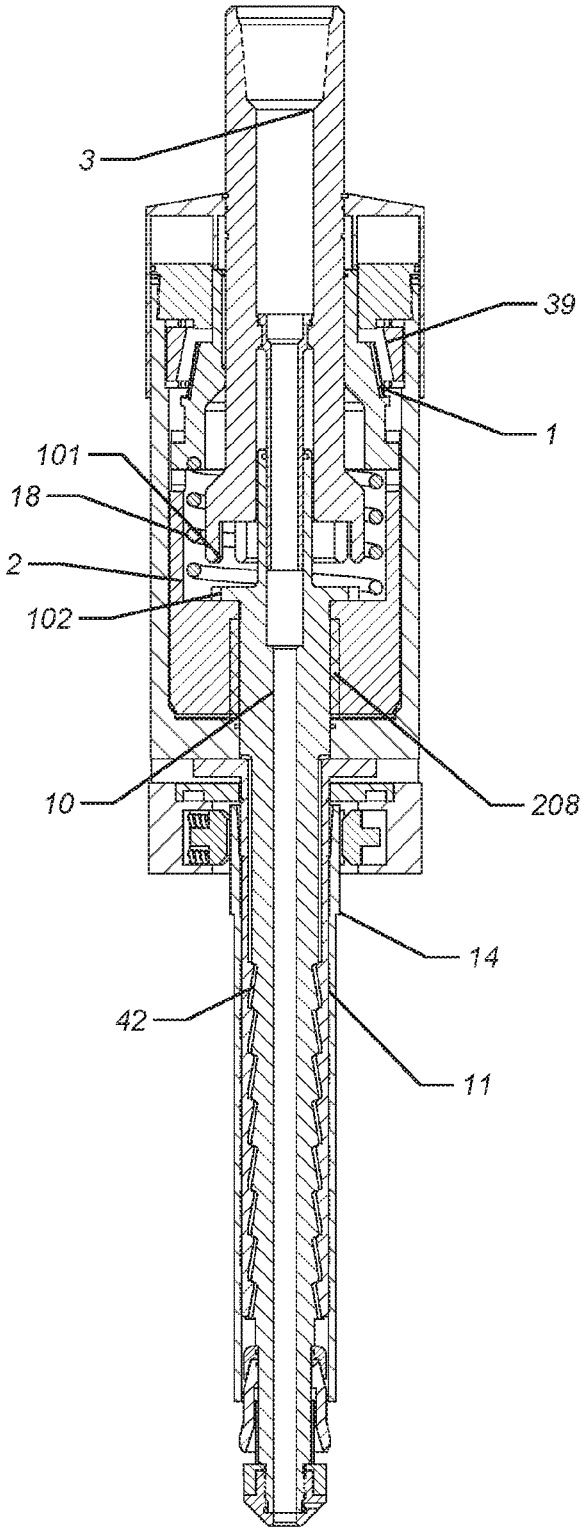
FIG. 10 is the view of FIG. 9 with weight set down to then allow slip extension with rotation.
Figure 11:
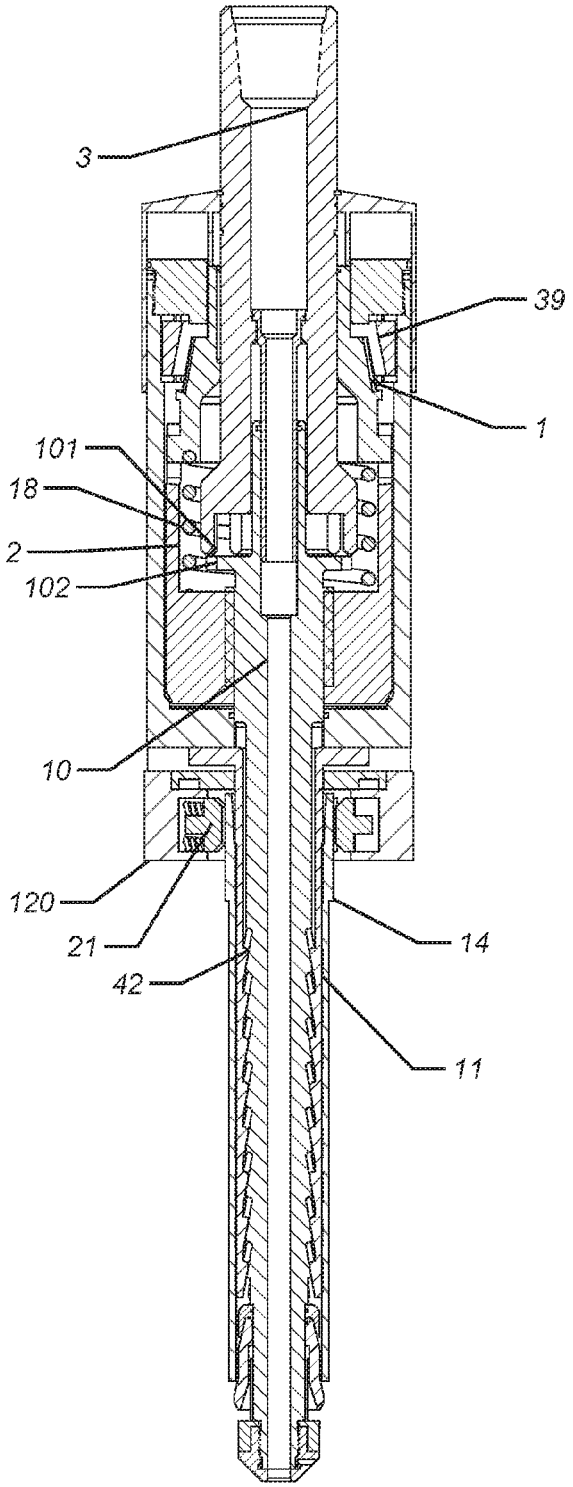
FIG. 11 is the view of FIG. 10 after rotation that has extended the slips against the casing.
Figure 12:
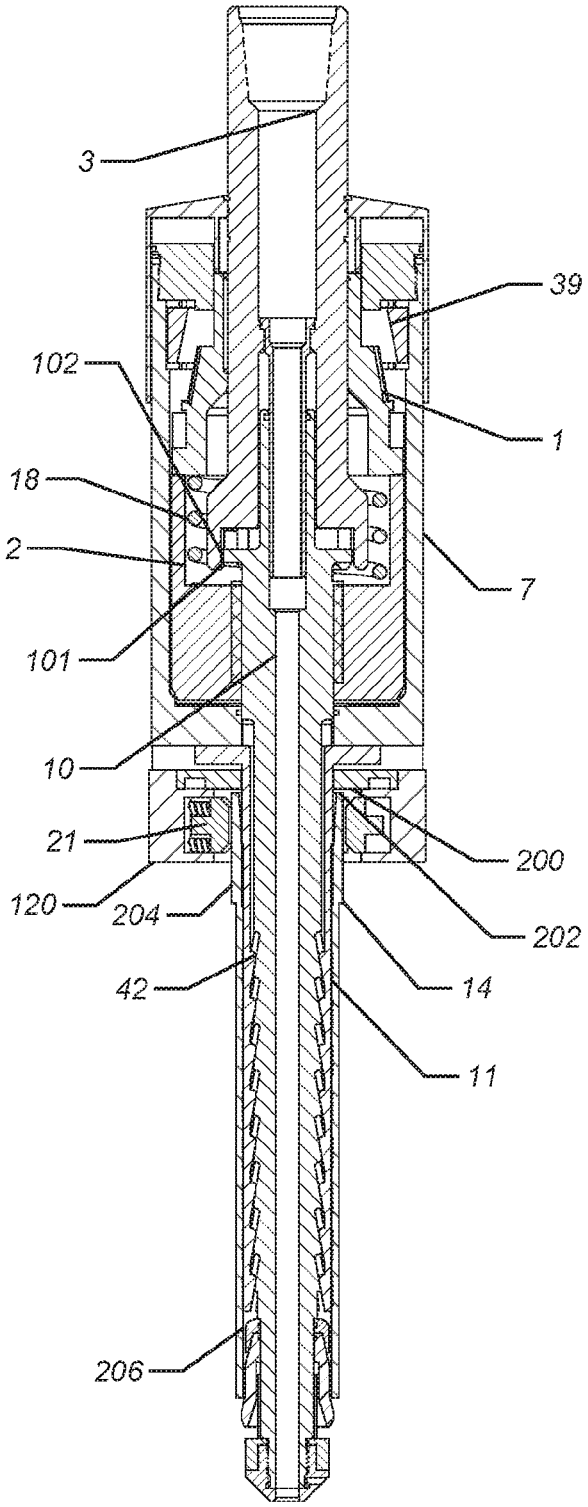
FIG. 12 is the view of FIG. 11 showing setting down weight after setting the slips to allow pushing on the casing string and rotated when running in the casing without further extending the slips.

Referring now to FIGS. 9-12 similar parts will have the same number as the above described embodiment. FIG. 9 shows the tool inserted into the tubular 14 to the point of the travel stop 200 being positioned just above the top 202 of the tubular 14. Actuator 10 is in a down position so that the slips 11 are retracted. Spring 18 pushes up on driving nut 1 which is rotationally locked at splines 39 to the housing 7. Drag block housing 120 is attached to housing 7 and has drag blocks 121 biased by springs 122 against the outer wall 204 of the tubular 14, which can be the topmost stand of a string of casing being run in or removed into or from a borehole that is not shown. Alternatively housing 120 can be inserted into the tubular 14 while still mounted to the housing 7 so that the inside wall 206 can be contacted by the drag blocks 121. The force of springs 122 on drag blocks 121 hold the housing 7 as the top sub 3 is put into position to rotate by a downward force to release from driving nut 1 as shown in FIG. 2. This setting down weight compresses spring 18 to release parts for relative rotation as a kind of clutch. The top sub 3 in the FIG. 10 position will turn in tandem with driving nut 1 and driven nut 2 and relative to the housing 7. That rotation raises the actuator 10 that is rotationally locked but axially movable due to the presence of thread 208. As the actuator 10 rises the ramps 42 push out the slips 11 against the tubular 14 until the needed grip torque is sensed at the top drive that is not shown. Further setting down weight on top sub 3 will engage splines 101 and 102 so that all the parts 1, 2 and 3 are again locked to the housing 7 which means they all turn together and further force to extend the slips against the tubular 14 is precluded. This avoid overstressing the tubular 14 after setting the slips in it during efforts to advance the tubular string and rotate it to advance the string into a borehole should there be some resistance to running in the hole such as a deviation, or hole partial collapse or other reasons to resist the advancement of the string associated with tubular 14. FIG. 12 shows advancing and rotating the string in a manner that will not further extend the slips 11 when setting down weight.

Those skilled in the art will appreciate that the drag blocks help to hold the housing fixed with respect to the tubular 14 so as to overcome friction in thread 208 when the slips 11 are extended by rotation of parts 1, 2 and 3 in tandem to raise the actuator 10 to extend slips 11. For insertion in FIG. 9, the spring 5 insures that the parts in the housing 7 are locked to it so none of the parts relatively rotate. With some set down weight a second position is assumed where the drag blocks hold the housing 7 to the tubular 14 as items 1, 2 and 3 rotate together relative to the actuator 10 that cannot rotate but can move axially due to thread 208. The slips now can be extended with the top drive to the required torque. Setting down weight further to a third position again locks items 1, 2 and 3 to the housing 7 so that rotating housing 7 will just rotate the tubular 14 without extending or retracting the slips 11. Picking up allows spring 18 to get the parts 1, 2 and 3 back to their original positions in FIG. 9.

The above description is illustrative of the preferred embodiment and many modifications may be made by those skilled in the art without departing from the invention whose scope is to be determined from the literal and equivalent scope of the claims below:

We claim:

1. A top drive operated tubular running tool assembly, comprising:

a housing supported by the top drive;

an assembly in said housing comprising rotational input from the top drive converted to movement of an actuator operably linked to at least one slip for selective grip and release of a tubular by said slip, said actuator selectively disabled from moving while said top drive provides rotational input;

said assembly in said housing for movement of said actuator selectively locking said actuator from relative movement with respect to the housing.

2. A top drive operated tubular running tool assembly, comprising:

a housing supported by the top drive;

an assembly in said housing to selectively transmit rotational input from the top drive and convert such rotational input to movement of an actuator operably linked to at least one slip for selective grip and release of a tubular by said slip;

said assembly in said housing for movement of said actuator selectively locking said actuator from relative movement with respect to the housing;

a drag block assembly mounted to said housing for selective contact with the tubular to hold said housing against rotation as said assembly in said housing is rotationally unlocked from said housing and rotated by said top drive.

3. The tool of claim 1, wherein:

said assembly comprises an actuator that is movable axially.

4. The tool of claim 3, wherein:

said actuator is engaged to a rotating component of said assembly by a thread.

5. The tool of claim 4, wherein:

rotation of said rotating component in clockwise and counterclockwise directions moves said actuator axially up and down using said thread.

6. The tool of claim 1, wherein:

said drag block assembly maintaining said housing stationary as said rotating component is rotated by overcoming frictional forces in said tubular running tool.

7. A top drive operated tubular running tool assembly, comprising:

a housing supported by the top drive;

an assembly in said housing to selectively transmit rotational input from the top drive and convert such rotational input to movement of an actuator operably linked to at least one slip for selective grip and release of a tubular by said slip;

said assembly in said housing for movement of said actuator selectively locking said actuator from relative movement with respect to the housing;

said assembly comprises an actuator that is movable axially;

said actuator is engaged to a rotating component of said assembly by a thread;

rotation of said rotating component in clockwise and counterclockwise directions moves said actuator axially up and down using said thread;

said drag block assembly maintaining said housing stationary as said rotating component is rotated by overcoming frictional forces in said thread;

said rotating component further comprises a top sub driven by the top drive that selectively engages said actuator to preclude movement of said slip as weight from the top drive is set on said top sub and a rotational force is applied to said top sub by the top drive.

8. The tool of claim 7, wherein:

a return spring is compressed to engage said top sub with said actuator.

9. The tool of claim 8, wherein:

setting down top drive weight on said top sub and against said return spring to a point short of engaging said actuator allows said top sub to rotate a driving and driven nuts in tandem with respect to said housing that is held by said drag blocks to the tubular.

10. The tool of claim 9, wherein:

said thread is located on said driven nut.

11. The tool of claim 10, wherein:

said at least one slip comprises a plurality of slips driven by said actuator on a series of multiple ramp surfaces.

12. A method of using a tubular running tool for assembling a string and running the string into a subterranean location, comprising:

supporting the running tool at a surface location;

providing at least one slip on the running tool that is supported at a surface location to selectively engage and release the tubular upon movement of an actuator with respect to a housing of said running tool;

mechanically selectively disabling said actuator from moving with respect to said housing while a driver for said actuator is operating.

13. The method of claim 12, comprising:

driving said actuator axially with a thread.

14. The method of claim 13, comprising:

retaining said housing to the tubular with at least one biased drag block to overcome frictional resistance in said thread.

15. A method of using a tubular running tool for assembling a string and running the string into a subterranean location, comprising:

supporting the running tool at a surface location;

providing at least one slip on said running tool that is supported at a surface location to selectively engage and release the tubular upon movement of an actuator with respect to a housing of said running tool;

mechanically selectively disabling said actuator from moving with respect to said housing;

driving said actuator axially with a thread;

retaining said housing to the tubular with at least one biased drag block to overcome frictional resistance in said thread;

rotating a top sub, extending into said housing, with a top drive;

rotationally locking said actuator to said housing;

selectively engaging said actuator with said top sub such that rotation of said top sub rotates said housing and the tubular when said slip engages the tubular.

16. The method of claim 15, comprising:

biasing said top sub away from said actuator.

17. The method of claim 16, comprising:

locking said top sub to said housing under the force of said biasing.

18. A method of using a tubular running tool for assembling a string and running the string into a subterranean location, comprising:

supporting the running tool at a surface location;

providing at least one slip on said running tool that is supported at a surface location to selectively engage and release the tubular upon movement of an actuator with respect to a housing of said running tool;

mechanically selectively disabling said actuator from moving with respect to said housing;

releasing a top sub for relative rotation with respect to said housing by partly compressing a spring providing said biasing.

19. The method of claim 18, comprising:

driving a driving nut and a driven nut in tandem with said top sub and relative to said housing, held by said drag block, when said spring is compressed;

providing said thread in said driven nut.

20. A method of using a tubular running tool for assembling a string and running the string into a subterranean location, comprising:

supporting the running tool at a surface location;

providing at least one slip on said running tool that is supported at a surface location to selectively engage and release the tubular upon movement of an actuator with respect to a housing of said running tool;

mechanically selectively disabling said actuator from moving with respect to said housing;

enabling said actuator to move axially with a set down weight of said running tool of less than said predetermined value and with an applied rotational force to said running tool for extension or retraction of said slip.

* * * * *